US007797766B2

(12) United States Patent
Ellinger

(10) Patent No.: US 7,797,766 B2
(45) Date of Patent: Sep. 21, 2010

(54) TOILET ODOR EXHAUST DEVICE

(76) Inventor: Robert W. Ellinger, 15 Cranberry Dr., Islip, NY (US) 11751

( * ) Notice: Subject to any disclaimer, the term of this patent is extended or adjusted under 35 U.S.C. 154(b) by 1171 days.

(21) Appl. No.: 11/430,219

(22) Filed: May 8, 2006

(65) Prior Publication Data

US 2007/0256219 A1 Nov. 8, 2007

(51) Int. Cl.
*E03D 9/04* (2006.01)

(52) U.S. Cl. ..... 4/213

(58) Field of Classification Search ..... 4/213, 4/216, 217, 228.1, 209 FF
See application file for complete search history.

(56) References Cited

U.S. PATENT DOCUMENTS

| | | | | | |
|---|---|---|---|---|---|
| 2,846,696 | A * | 8/1958 | Herriott | ..... | 4/213 |
| 3,295,147 | A * | 1/1967 | Meyer | ..... | 4/213 |
| 3,491,382 | A | 1/1970 | Poister | | |
| 3,585,651 | A | 6/1971 | Cox | | |
| 4,251,888 | A | 2/1981 | Turner | | |
| 4,317,242 | A * | 3/1982 | Stamper | ..... | 4/213 |
| 5,179,737 | A | 1/1993 | Ricard | | |
| 5,452,481 | A | 9/1995 | Meyer | | |
| 5,454,122 | A * | 10/1995 | Bergeron | ..... | 4/217 |
| 5,519,897 | A * | 5/1996 | DeSimone | ..... | 4/213 |
| 5,671,484 | A | 9/1997 | Lee, III | | |
| 5,819,324 | A | 10/1998 | Bianco | | |
| 5,857,222 | A | 1/1999 | Keys | | |
| 6,041,449 | A * | 3/2000 | Brown et al. | ..... | 4/213 |
| 6,082,979 | A | 7/2000 | Friedman | | |
| 6,588,025 | B1 | 7/2003 | Helmolt | | |
| 6,678,900 | B2 * | 1/2004 | Ware | ..... | 4/213 |

* cited by examiner

*Primary Examiner*—Tuan N Nguyen
(74) *Attorney, Agent, or Firm*—Richard L. Miller; Registered Patent Agent

(57) ABSTRACT

A toilet odor exhaust device for a toilet having a toilet bowl with a rim portion and a hinged seat. The device comprises an air intake nozzle and a vacuum filtering unit. A conduit connects the air intake nozzle to the vacuum filtering unit. A structure is for removably attaching the vacuum filtering unit to the rim portion of the toilet bowl, so that the air intake nozzle will fit between the rim portion of the toilet bowl and the seat. A mechanism is for activating the vacuum filtering unit, when a person sits upon the seat on the toilet bowl. Foul air in the toilet bowl will be sucked through the air intake nozzle, the conduit and into the vacuum filtering unit, in which clean air will exit from the vacuum filtering unit.

8 Claims, 2 Drawing Sheets

Fig. 1
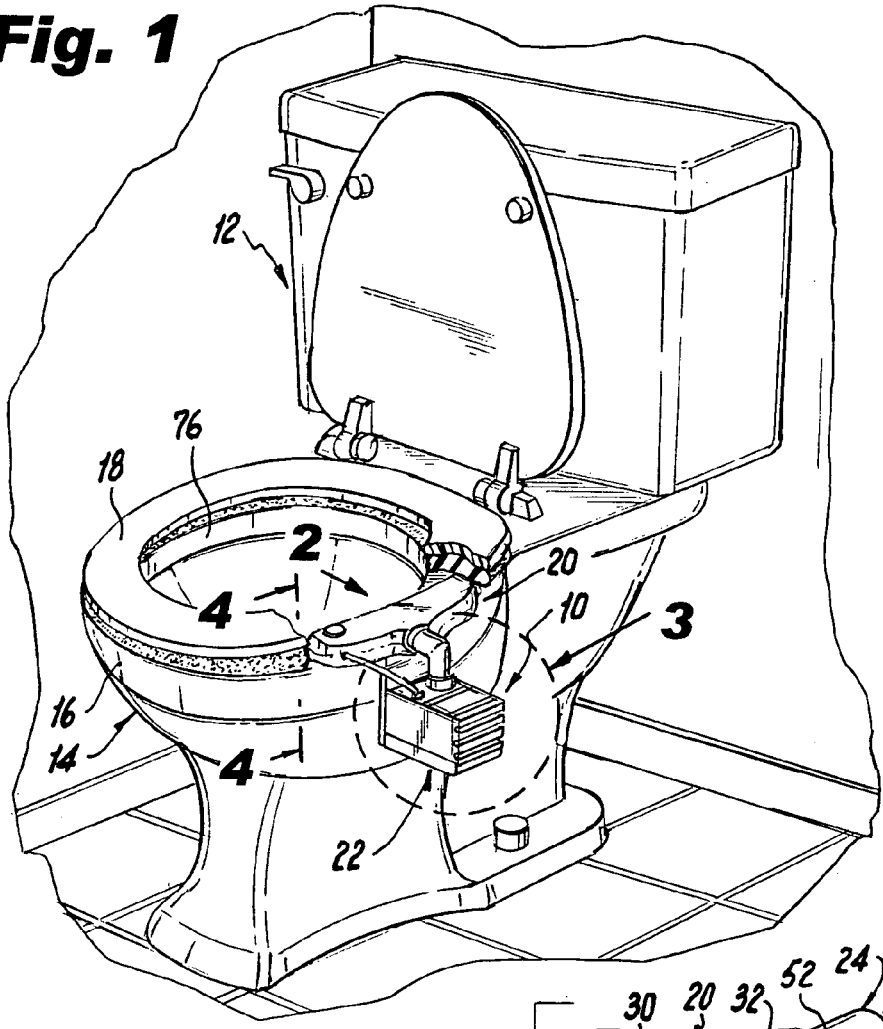
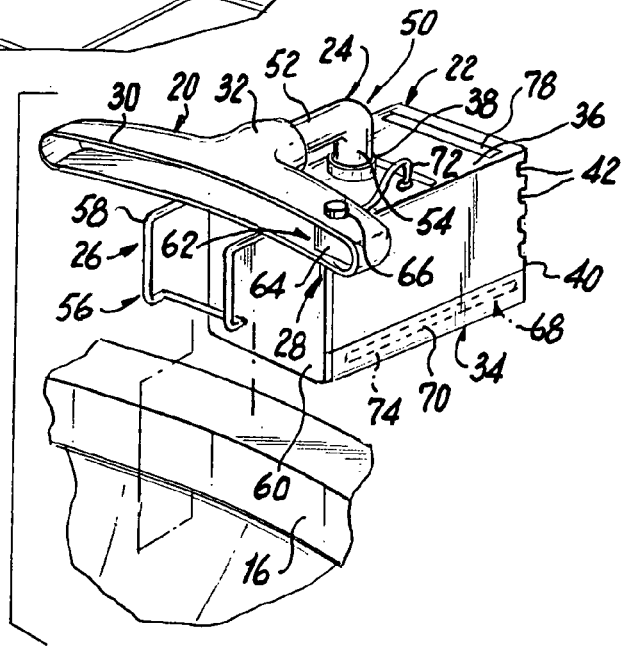
Fig. 2

TOILET ODOR EXHAUST DEVICE

BACKGROUND OF THE INVENTION

1. Field of the Invention

The present invention relates to a ventilation system, and more particularly, a toilet odor exhaust device.

2. Description of the Prior Art

Numerous innovations for toilet ventilating devices have been provided in the prior art that will be described. Even though these innovations may be suitable for the specific individual purposes to which they address, however, they differ from the present invention.

A FIRST EXAMPLE, U.S. Pat. No. 3,491,382, Issued on Jan. 27, 1970, to Poister teaches an invention that relates to ventilated toilet stools and, more particularly, to an air filtering apparatus having an inlet air chamber attachable to a conventional toilet seat or bowl to transfer air therefrom into a filter structure for purification. More specifically, the invention relates to a toilet stool ventilating apparatus having air inlet sections adjacent the upper open rim portion of the toilet bowl operable to convey air therefrom to a remote filter structure for removing odors therein by an activated charcoal filter element. Additionally, the invention relates to a toilet stool ventilating means having an air chamber constructed within an upper rim portion of a toilet bowl to convey air from within the bowl to a remote filtering structure for the purification thereof.

A SECOND EXAMPLE, U.S. Pat. No. 3,585,651, Issued on Jun. 22, 1971, to Cox teaches a device for removing obnoxious odors from a toilet, such device includes a hose with an inlet fitting connected to one end for attachment to the underside of the toilet seat near the rear and a discharge fitting at its opposite end for extending through a wall to an exterior air space and with a blower or fan operatively connected to such discharge fitting for producing suction through the hose for withdrawing air from the toilet bowl and discharging it beyond the wall, the inlet fitting having incorporated therein a resilient switch completely encased in plastic with embedded electric contacts adapted to be engaged by the weight of a person on the toilet seat to supply electric current to cause operation of the motor.

A THIRD EXAMPLE, U.S. Pat. No. 4,251,888, Issued on Feb. 24, 1981, to Turner teaches a toilet seat having a hollow central portion therein with holes in the front and rear of the inner lateral sides through which air is drawn inwardly. Vacuum hoses are connected to the hollow central portion of the toilet seat and lead to a vacuum pump mounted near the toilet. The vacuum pump sucks the odor-laden air from the toilet seat area and blows it to the outside through an expulsion tube.

A FOURTH EXAMPLE, U.S. Pat. No. 5,179,737, Issued on Jan. 19, 1993, to Ricard teaches an odor removing device for toilets that includes an odor collector secured to the conventional hinge posts of a toilet bowl. The odor collector has a single inlet opening and is connected in communicating relation to a downwardly convex auxiliary venturi housing which overlays the conventional bathroom ceiling fan. An air stream is introduced centrally into the auxiliary venturi and produces a venturi effect to thereby cause rapid evacuation of the noxious gases, steam and the like.

A FIFTH EXAMPLE, U.S. Pat. No. 5,452,481, Issued on Sep. 26, 1995, to Meyer teaches a portable ventilation system that includes an air filter unit located remotely from a toilet and having an air duct extending from the filter unit to the toilet to exhaust and deodorize air from the toilet bowl. The filter unit includes an impeller which moves air through charcoal type filter media and exits the filter unit through a plurality of apertures in the bottom of the unit. An air duct is slidably journaled between the toilet seat and toilet bowl rim upper surface at the rearward end of the seat, and is connected to the filter unit to draw air from the toilet bowl and through the filter unit. A control unit is electrically connected to the filter unit and includes a switch to activate the impeller in the filter unit to operate the ventilation system. In one embodiment of the invention, a sensor is mounted in the control unit so as to sense the presence of a person on the toilet to automatically activate the filtration system.

A SIXTH EXAMPLE, U.S. Pat. No. 5,671,484, Issued on Sep. 30, 1997, to Lee, III teaches a toilet ventilator apparatus that includes a toilet seat with an odor collection channel formed therein. Such channel terminates at an evacuation nozzle. Also included is at least one odor collection vent which is adapted for receiving unpleasant odors from the air within the vicinity of a toilet bowl. A vacuum is coupled to the evacuation nozzle of the toilet seat for transferring unpleasant odors contained within the air in the vicinity of a toilet bowl through the toilet seat to a location remote from the toilet bowl via a fan when energized. Further provided is a scenting mechanism for masking the unpleasant odors contained in the evacuated air. The scenting mechanism has an associated conduit with an outlet thereof situated adjacent the fan of the vacuum and a scent switch for allowing the air containing odor to be scented upon the depression thereof.

A SEVENTH EXAMPLE, U.S. Pat. No. 5,819,324, Issued on Oct. 13, 1998, to Bianco teaches a ventilation device for use with a standard toilet assembly commonly found in a household bathroom. The ventilation device includes a base which is mounted on the rim portion of the toilet bowl. A vacuum member having a hollow interior and containing a plurality of apertures is superimposed on the inner periphery of the base. A handle having a hollow interior is integrally formed with the vacuum member, and a connecting pipe is coupled to the free end of the handle. Suction devices are provided and operatively coupled to the connecting pipe in order draw odors from the toilet bowl and direct them to a remote location. The ventilation device may be used with multiple toilet assemblies via a common exhaust line. The device can also be adapted for use with various sizes of toilet assemblies.

AN EIGHTH EXAMPLE, U.S. Pat. No. 5,857,222, Issued on Jan. 12, 1999, to Keys teaches an apparatus for removal of odours from a toilet that comprises a vacuum motor and a hose connected to the interior of a toilet pan. The toilet seat includes a hinge comprising a central hollow duct provided with apertures which face the toilet plan for removal of odours therefrom. The odours are sucked from the toilet through the duct and hose and through a vacuum motor assembly and expelled through an outlet in the vacuum motor assembly.

A NINTH EXAMPLE, U.S. Pat. No. 6,082,979, Issued on Jul. 4, 2000, to Friedman teaches a vacuum toilet assembly which includes a vacuum toilet and a vacuum tank (e.g. a combined holding and vacuum tank) that uses a simple air pump to remove air from the tank to create a partial vacuum. The air pump is capable of achieving about ten inches mercury of vacuum in an empty 9.5 gallon vacuum tank in roughly one minute, and can pump at least about one liter of liquid per minute. A combined sound muffler and odor filter and/or rat-tail check valve and noise reducer, is/are connected to the outlet from the air plump. The pump comprises a powered reciprocating diaphragm pump having a reciprocating diaphragm powered by an electric motor rotating an eccentric at about 2300 rpm, and oppositely directed first and second disk valves. The disk valves have elastomeric disk valve elements die-cut from flat sheets which cooperate with perforated concave surfaces in a dividing wall in the pump housing. The reciprocating diaphragm has a total stroke length of about 0.3-0.33 inches.

A TENTH EXAMPLE, U.S. Pat. No. 6,588,025 B1, Issued on Jul. 8, 2003, to Helmolt teaches a new and improved device, kit and associated method of using is for placement onto a standard commode having a movable toilet seat pivotally hinged to a bowl of the commode and for venting noxious odors emanating from the bowl. The device comprises a base, a vent chamber, a collection tube, a housing and a vent tube. The base and the vent chamber are positioned near the rear top portion of the bowl in which when the toilet seat is in a horizontally lowered position, then an on/off switch is enabled which activates the fan within the housing to suck any noxious odors from the vicinity of the bowl through the vent tube via the vent chamber, collection tube and housing. The kit comprises the unassembled components of the device. The method of using comprises the steps of adhering, adjoining, affixing, coupling, defecating, drilling, dropping, flushing, inserting, leaving, lifting, obtaining, plugging, pressing, sitting, standing, and sticking.

It is apparent now that numerous innovations for toilet ventilating devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a toilet odor exhaust device that avoids the disadvantages of the prior art.

ANOTHER OBJECT of the present invention is to provide a toilet odor exhaust device that is simple and inexpensive to manufacture.

STILL ANOTHER OBJECT of the present invention is to provide a toilet odor exhaust device that is simple to use.

BRIEFLY STATED, STILL YET ANOTHER OBJECT of the present invention is to provide a toilet odor exhaust device for a toilet having a toilet bowl with a rim portion and a hinged seat. The device comprises an air intake nozzle and a vacuum filtering unit. A conduit connects the air intake nozzle to the vacuum filtering unit. A structure is for removably attaching the vacuum filtering unit to the rim portion of the toilet bowl, so that the air intake nozzle will fit between the rim portion of the toilet bowl and the seat. A mechanism is for activating the vacuum filtering unit, when a person sits upon the seat on the toilet bowl. Foul air in the toilet bowl will be sucked through the air intake nozzle, the conduit and into the vacuum filtering unit, in which clean air will exit from the vacuum filtering unit.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic perspective view of a toilet, with parts broken away, showing the present invention installed thereon;

FIG. 2 is an enlarged diagrammatic perspective view taken in the direction of arrow 2 in FIG. 1, showing the present invention exploded from a portion of the toilet bowl;

A MARSHALLING OF REFERENCE NUMERALS UTILIZED IN THE DRAWING

Figure 3:
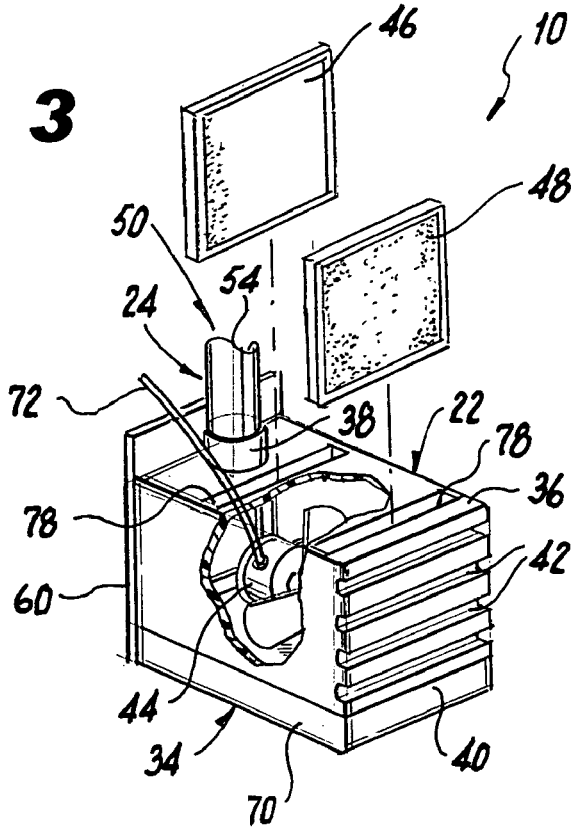
FIG. 3 is an enlarged diagrammatic perspective view, of the area indicated by arrow 3 in FIG. 1 with parts broken away, showing how the charcoal and fragrance filters may be installed and removed from the box-shaped housing.

10 toilet odor exhaust device
12 toilet
14 toilet bowl of toilet 12
16 rim portion of toilet bowl 14
18 hinged seat of toilet 12
20 air intake nozzle of device 10
22 vacuum filtering unit of device 10
24 conduit of device 10
26 removably attaching structure of device 10
28 activating mechanism of device 10
30 front flat wide inlet mouth of air intake nozzle 20
32 rear circular outlet neck of air intake nozzle 20
34 box-shaped housing of vacuum filtering unit 22
36 top wall of box-shaped housing 34
38 air input collar on top wall 36
40 rear wall of box-shaped housing 34
42 air outlet vent in rear wall 40
44 exhaust fan in box-shaped housing 34
46 charcoal filter in box-shaped housing 34
48 fragrance filter in box-shaped housing 34
50 air tube for conduit 24
52 first end of air tube 50
54 second end of air tube 50
56 clip member for removable attaching structure 26
58 bent metal wire of clip member 56
60 front wall of box-shaped housing 34
62 pressure switch of activating mechanism 28
64 body of pressure switch 62
66 activating button of pressure switch 62
68 power source of activating mechanism 28
70 lower portion of box-shaped housing 34
72 electrical wire of activating mechanism 28
74 battery for power source 68
76 compressible foam cushion of device 10
78 transverse slot in top wall 36

DETAILED DESCRIPTION OF THE PREFERRED EMBODIMENT

Figure 4:
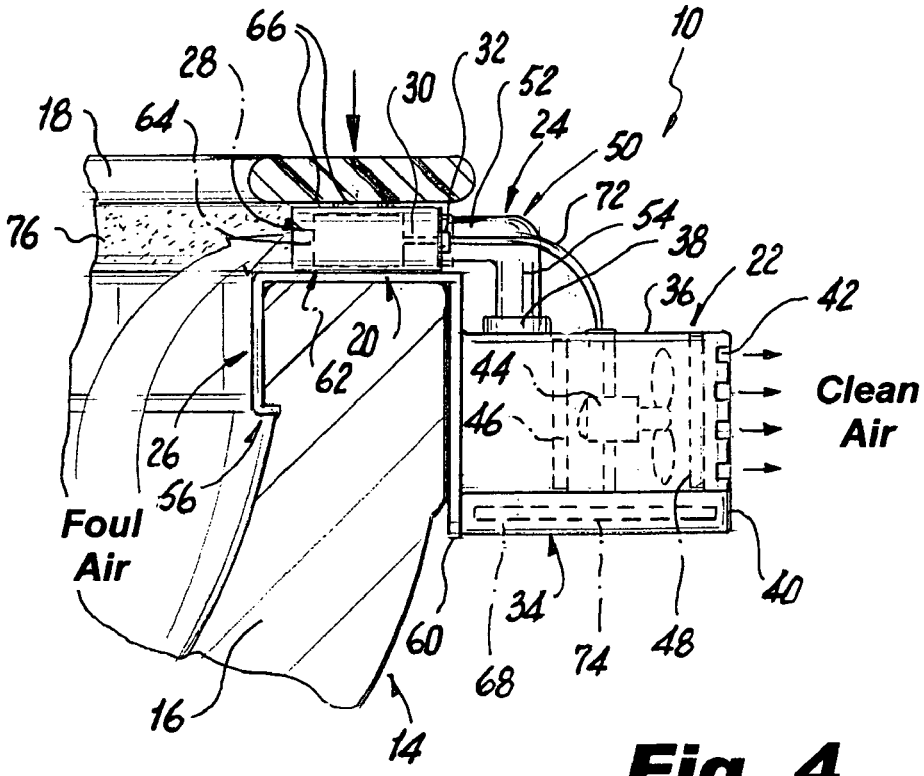
FIG. 4 is an enlarged diagrammatic cross sectional view taken on line 4-4 of FIG. 1.

Referring now to the figures, in which like numerals indicate like parts, and particularly to FIGS. 1 through 4, which are a diagrammatic perspective view of a toilet, with parts broken away, showing the present invention installed thereon; an enlarged diagrammatic perspective view taken in the direction of arrow 2 in FIG. 1, showing the present invention exploded from a portion of the toilet bowl; an enlarged diagrammatic perspective view, of the area indicated by arrow 2 in FIG. 1, with parts broken away, showing how the charcoal and fragrance filters may be installed and removed from the box-shaped housing; and an enlarged diagrammatic cross sectional view taken on line 4-4 of FIG. 1, and as such, will be discussed with reference thereto.

The present invention is a toilet odor exhaust device 10 for a toilet 12, having a toilet bowl 14 with a rim portion 16 and a hinged seat 18. The device 10 comprises an air intake nozzle 20 and a vacuum filtering unit 22. A conduit 24 connects the air intake nozzle 20 to the vacuum filtering unit 22. A structure 26 is for removably attaching the vacuum filtering unit 22 to the rim portion 16 of the toilet bowl 14, so that the air intake nozzle 20 will fit between the rim portion 16 of the toilet bowl 14 and the seat 18. A mechanism 28 is for activating the vacuum filtering unit 22, when a person sits upon the seat 18 on the toilet bowl 14. Foul air in the toilet bowl 14 will be sucked through the air intake nozzle 20, the conduit 24 and into the vacuum filtering unit 22, in which clean air will exit from the vacuum filtering unit 22.

The air intake nozzle 20 includes a front flat wide inlet mouth 30 and a rear circular outlet neck 32. The vacuum filtering unit 22 consists of a box-shaped housing 34, having a top wall 36 with an air input collar 38 and a rear wall 40, having a plurality of air outlet vents 42. The box-shaped housing 34 of the vacuum filtering unit 22 includes an exhaust fan 44 mounted therein. The box-shaped housing 34 of the vacuum filtering unit 22 further includes a charcoal filter 46 placed therein between the air input collar 38 on the top wall 30 and the exhaust fan 44. A fragrance filter 48 is placed therein between the exhaust fan 44 and the rear wall 40, having the plurality of air outlet vents 42.

The conduit 24 is an air tube 50 bent at a right angle within a first end 52 of the air tube 50 connected to the rear circular outlet neck 32 of the air intake nozzle 20, and a second end 54 of the air tube 50 connected to the air input collar 38 on the top wall 36 of the box-shaped housing 34 of the vacuum filtering unit 22. The removably attaching structure 26 is a clip member. The clip member 56 consists of a bent metal wire 58 extending from a front wall 60 of the box-shaped housing 34 of the vacuum filtering unit 22.

The activating mechanism 28 includes a pressure switch 62 having a body 64 and an activating button 66. The body 64 of the pressure switch 66 is mounted within and to one side of the front flat wide inlet mouth 30 with the activating button 66 extending up through the front flat wide inlet mouth 30 of the air intake nozzle 20. A power source 68 is carried in a lower portion 70 of the box-shaped housing 34 of the vacuum filtering unit 22. The power source 68 is at least one battery 74.

The device 10 further contains a compressible foam cushion 76 appropriately sized and dimensioned to mount on the rim portion 16 of the toilet bowl 14 and extends from opposite sides of the front flat wide inlet mouth 30 of the air intake nozzle 20. The compressible foam cushion 76 will add comfort when the person sits upon the seat 18 on the toilet bowl 14. The box-shaped housing 34 of the vacuum filtering unit 22 further includes the top wall 36, having a pair of spaced apart transverse slots 78. The charcoal filter 46 and the fragrance filter 48 can be inserted into and removed from the respective transverse slots 78 in the top wall 36 of the box-shaped housing 34 (see FIG. 3).

It will be understood that each of the elements described above, or two or more together, may also find a useful application in other types of constructions differing from the types described above.

While the invention has been illustrated and described as embodiments of a toilet odor exhaust device, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A toilet odor exhaust device for a toilet having a toilet bowl with a rim portion and a hinged seat, said device comprising:

a) an air intake nozzle;

b) a vacuum filtering unit;

c) a conduit to connect said air intake nozzle to said vacuum filtering unit;

d) means for removably attaching said vacuum filtering unit to the rim portion of the toilet bowl, so that said air intake nozzle will fit between the rim portion of the toilet bowl and the seat; and e) means for activating said vacuum filtering unit, when a person sits upon the seat on the toilet bowl, so that foul air in the toilet bowl will be sucked through said air intake nozzle, said conduit and into said vacuum filtering unit, in which clean air will exit from said vacuum filtering unit;

wherein said air intake nozzle comprises:

i) a front flat wide inlet mouth; and ii) rear circular outlet neck;

wherein said vacuum filtering unit comprises a box-shaped housing having a top wall with an air input collar and a rear wall having a plurality of air outlet vents;

wherein said box-shaped housing of said vacuum filtering unit comprises an exhaust fan mounted therein;

wherein said box-shaped housing of said vacuum filtering unit further comprises:

A) a charcoal filter placed therein between said air input collar on said top wall and said exhaust fan; and B) a fragrance filter placed therein between said exhaust fan and said rear wall having said plurality of air outlet vents;

wherein said box-shaped housing of said vacuum filtering unit further comprises said top wall having a pair of spaced apart transverse slots; and wherein said charcoal filter and said fragrance filter are inserted into and removed from said respective transverse slots in said top wall of said box-shaped housing.

2. The device as recited in claim 1, wherein said conduit comprises an air tube bent at a right angle with a first end of said air tube connected to said rear circular outlet neck of said air intake nozzle and a second end of said air tube connected to said air input collar on said top wall of said box-shaped housing of said vacuum filtering unit.

3. The device as recited in claim 1, wherein said removably attaching means is a clip member.

4. The device as recited in claim 3, wherein said clip member consists of a bent metal wire extending from a front wall of said box-shaped housing of said vacuum filtering unit.

5. The device as recited in claim 1, wherein said activating means comprises:

a) a pressure switch having a body and an activating button, said body of said pressure switch mounted within and to one side of said front flat wide inlet mouth with said activating button extending up through said front flat wide inlet mouth of said air intake nozzle;

b) a power source carried in a lower portion of said box-shaped housing of said vacuum filtering unit; and c) an electrical wire extending between said pressure switch, said power source and said exhaust fan within said box-shaped housing of said vacuum filtering unit.

6. The device as recited in claim 5, wherein said power source is at least one battery.

7. The device as recited in claim 1, further comprising a compressible foam cushion appropriately sized and dimensioned to mount on the rim portion of the toilet bowl and extends from opposite sides of said front flat wide inlet mouth of said air intake nozzle, wherein said compressible foam cushion will add comfort when the person sits upon the seat on the toilet bowl.

8. A toilet odor exhaust device for a toilet having a toilet bowl with a rim portion and a hinged seat, said device comprising:

a) an air intake nozzle;

b) a vacuum filtering unit;

c) a conduit to connect said air intake nozzle to said vacuum filtering unit;

d) means for removably attaching said vacuum filtering unit to the rim portion of the toilet bowl, so that said air intake nozzle will fit between the rim portion of the toilet bowl and the seat; and e) means for activating said vacuum filtering unit, when a person sits upon the seat on the toilet bowl, so that foul air in the toilet bowl will be sucked through said air intake nozzle, said conduit and into said vacuum filtering unit, in which clean air will exit from said vacuum filtering unit, wherein said air intake nozzle comprises:

f) a front flat wide inlet mouth; and g) a rear circular outlet neck, wherein said vacuum filtering unit comprises a box-shaped housing having a top wall with an air input collar and a rear wall having a plurality of air outlet vents, wherein said box-shaped housing of said vacuum filtering unit comprises an exhaust fan mounted therein, wherein said box-shaped housing of said vacuum filtering unit further comprises:

h) a charcoal filter placed therein between said air input collar on said top wall and said exhaust fan; and i) a fragrance filter placed therein between said exhaust fan and said rear wall having said plurality of air outlet vents, wherein said conduit comprises an air tube bent at a right angle with a first end of said air tube connected to said rear circular outlet neck of said air intake nozzle and a second end of said air tube connected to said air input collar on said top wall of said box-shaped housing of said vacuum filtering unit, wherein said removably attaching means is a clip member, wherein said clip member consists of a bent metal wire extending from a front wall of said box-shaped housing of said vacuum filtering unit, wherein said activating means comprises:

j) a pressure switch having a body and an activating button, said body of said pressure switch mounted within and to one side of said front flat wide inlet mouth with said activating button extending up through said front flat wide inlet mouth of said air intake nozzle;

k) a power source carried in a lower portion of said box-shaped housing of said vacuum filtering unit; and l) an electrical wire extending between said pressure switch, said power source and said exhaust fan within said box-shaped housing of said vacuum filtering unit, wherein said power source is at least one battery, further comprising a compressible foam cushion appropriately sized and dimensioned to mount on the rim portion of the toilet bowl and extends from opposite sides of said front flat wide inlet mouth of said air intake nozzle, wherein said compressible foam cushion will add comfort when the person sits upon the seat on the toilet bowl, wherein said box-shaped housing of said vacuum filtering unit further comprises said top wall having a pair of spaced apart transverse slots, wherein said charcoal filter and said fragrance filter can be inserted into and removed from said respective transverse slots in said top wall of said box-shaped housing.

* * * * *